US008285190B2

(12) United States Patent
Derimiggio et al.

(10) Patent No.: US 8,285,190 B2
(45) Date of Patent: Oct. 9, 2012

(54) PAPER EDGE-BEVELING METHOD, AND AN IMAGE FORMING DEVICE INCLUDING THE SAME

(75) Inventors: John E Derimiggio, Fairport, NY (US); Brian J. Mcnamee, Brockport, NY (US)

(73) Assignee: Xerox Corporation, Norwalk, CT (US)

( * ) Notice: Subject to any disclaimer, the term of this patent is extended or adjusted under 35 U.S.C. 154(b) by 1241 days.

(21) Appl. No.: 11/945,435

(22) Filed: Nov. 27, 2007

(65) Prior Publication Data

US 2009/0136278 A1 May 28, 2009

(51) Int. Cl.

| | |
|---|---|
| ***G03G 15/00*** | (2006.01) |
| ***G03G 21/00*** | (2006.01) |
| *B65H 29/70* | (2006.01) |

(52) U.S. Cl. ..... 399/361; 399/381; 271/8.1

(58) Field of Classification Search ..... 271/8.1; *G03G 15/00, 21/00; B65H 29/70*

See application file for complete search history.

(56) References Cited

U.S. PATENT DOCUMENTS

| | | | | |
|---|---|---|---|---|
| 1,008,609 | A | 11/1911 | Moore | |
| 2,180,433 | A | 11/1939 | Page et al. | |
| 2,217,306 | A | 8/1940 | Burrill | |
| 3,934,113 | A | 1/1976 | Bar-on | |
| 4,042,804 | A | 8/1977 | Moser | |
| 5,697,036 | A | 12/1997 | Moser | |
| 5,933,677 | A * | 8/1999 | Lee | 399/20 |
| 6,782,233 | B2 | 8/2004 | Condello et al. | |
| 7,280,793 | B2 | 10/2007 | Zess et al. | |
| 2005/0047840 | A1 * | 3/2005 | Ohashi | 399/388 |

FOREIGN PATENT DOCUMENTS

| | | | |
|---|---|---|---|
| GB | 2274808 | A * | 8/1994 |
| JP | 01064943 | A * | 3/1989 |
| JP | 08227248 | A * | 9/1996 |

OTHER PUBLICATIONS

Official translation of JP 01064943 A (Sawafuji et al), by The McElroy Translation Company, Nov. 2010.*
Machine Translation of JP 08227248 A, JPO, Aug. 31, 2011.*

* cited by examiner

*Primary Examiner* — Judy Nguyen
*Assistant Examiner* — Nguyen Q Ha
(74) *Attorney, Agent, or Firm* — Gibb & Riley, LLC

(57) ABSTRACT

Fuser roller edgewear is reduced by a prior beveling of the inboard edge, the outboard edge, or both, of paper sheets that are to be provided to the fuser.

7 Claims, 9 Drawing Sheets

PAPER EDGE-BEVELING METHOD, AND AN IMAGE FORMING DEVICE INCLUDING THE SAME

INCORPORATION BY REFERENCE OF OTHER U.S. PATENT DOCUMENTS

The disclosures of the following eight (8) U.S. Patent Documents in their entirety hereby are totally incorporated herein by reference:

U.S. Pat. No. 7,280,793 B2, "Fuser arranged for braking and an image forming device including the same", issued 9 Oct. 2007 to Martin F. Zess et al., assigned to Xerox Corporation.

U.S. Pat. No. 6,782,233 B2, "Externally heated thick belt fuser", issued 24 Aug. 2004 to Anthony S. Condello et al., assigned to Xerox Corporation;

U.S. Pat. No. 5,697,036, "Single roll RAM system", issued 9 Dec. 1997 to Rabin Moser, assigned to Xerox Corporation;

U.S. Pat. No. 4,042,804, "Roll fuser apparatus", issued 16 Aug. 1977 to Rabin Moser, assigned to Xerox Corporation;

U.S. Pat. No. 3,934,113, "Roll fuser apparatus and mounting arrangement therefor", issued 20 Jan. 1976 to Ari Bar-on, assigned to Xerox Corporation;

U.S. Pat. No. 2,217,306, "Paper widening machine", issued 8 Oct. 1940 to Harold Griswold Burrill;

U.S. Pat. No. 2,180,433, "Method of and apparatus for manufacturing wallboard joint tape", issued 21 Nov. 1939 to John Page et al.; and U.S. Pat. No. 1,008,609, "Machine for making deckle and thin edged paper", issued 14 Nov. 1911 to Joseph W. Moore.

BACKGROUND OF THE INVENTION

The present disclosure pertains to image forming devices that include fusers and a paper process to reduce fuser roller edgewear.

As is known, in a typical electrophotographic copying or printing process, a charged photoconductor is exposed to form an electrostatic latent image. As described in the aforementioned U.S. Pat. No. 6,782,233 to Anthony S. Condello et al. ("Condello"), at column 1, lines 12-41, this latent image is then developed by bringing a developer material such as toner in contact therewith. The toner is deposited as a latent electrostatic image on the photoconductor. The toner image is then transferred from the photoconductor to a copy substrate such as, for example, paper or another media. In order to fix or fuse the toner onto the media permanently by heat, the toner material is heated to cause the toner to flow onto the fibers or pores of the media. Thereafter, as the toner cools, the toner solidifies, thus causing the toner to permanently bond to the media.

Typical fusing arrangements are described in the foregoing Condello patent, especially from column 1, line 42 to column 4, line 9.

Still further fusing arrangements are described in the aforementioned further four (4) U.S. Pat. No. 7,280,793 granted 9 Oct. 2007 to Martin F. Zess et al.; No. 5,697,036 granted 9 Dec. 1997 to Rabin Moser; No. 4,042,804 granted 16 Aug. 1997 to Rabin Moser; and No. 3,934,113 granted 20 Jan. 1976 to Ari Bar-on. The disclosures of the aforementioned five (5) patents to Anthony S. Condello et al., Martin F. Zess et al., Rabin Moser (2 patents) and Ari Bar-on are herein incorporated by reference verbatim and with the same effect as though the identical disclosures were presented hereinat in their entireties.

As is known, fuser rollers wear Fuser rollers wear due to the cutting action of the edges of paper as they move through the fuser. The problem generally worsens as the caliper of the paper increases. The wear is most severe on the nip forming roller of the fuser roller pair. This is because there is a concentrated speed differential of the elastomer at the paper edge due to the incompressibility of the elastomer and the strain discontinuity produced by the paper edge. If the nip forming roller is also the fuser roller (as in IGEN), this wear area inevitably cause an image defect which negatively impacts the fuser roller life.

Prior to the present disclosure the only way to reduce the problem is to search for better wearing elastomers (very difficult) or to reduce average strain which trades off fusing performance.

Thus, there is a need for the present invention.

BRIEF SUMMARY OF THE INVENTION

In a first aspect of the invention, there is provided a method for an image forming device to process a paper sheet, the paper sheet having an inboard edge, an outboard edge and a top surface, the method comprising: (a) forming a beveled-edge paper sheet by any of (i) enlarging the inboard edge-top surface angle that is formed by the inboard edge and the top surface and (ii) enlarging the outboard edge-top surface angle that is formed by the outboard edge and the top surface; and (b) providing the paper beveled-edge sheet to an included fuser.

In a second aspect of the invention, there is provided a method for reducing fuser roller edgewear in a fuser, the fuser arranged for fusing one or more paper sheets, each paper sheet having an inboard edge, an outboard edge and a top surface, the method comprising, for each paper sheet to be provided to the fuser, (i) enlarging the inboard edge-top surface angle that is formed by the inboard edge and the top surface; or (ii) enlarging the outboard edge-top surface angle that is formed by the outboard edge and the top surface; or both (i) and (ii).

In a third aspect of the invention, there is provided a method for processing a paper sheet, the paper sheet having an inboard edge, an outboard edge and a top surface, the method comprising any of (i) enlarging the inboard edge-top surface angle that is formed by the inboard edge and the top surface and (ii) enlarging the outboard edge-top surface angle that is formed by the outboard edge and the top surface, thus forming a beveled-edge paper sheet; disposing a marking on the paper beveled-edge sheet thus forming a marked paper beveled-edge sheet, and providing the marked paper beveled-edge sheet to an included fuser.

In a fourth aspect of the invention, there is provided an image forming device arranged to process paper sheets, each paper sheet having an inboard edge, an outboard edge and a top surface, the image forming device arranged for edge-beveling each paper sheet by any of (i) enlarging the inboard edge-top surface angle that is formed by the inboard edge and the top surface and (ii) enlarging the outboard edge-top surface angle that is formed by the outboard edge and the top surface, thus forming a beveled-edge sheet, the device including marking means for disposing a marking on the beveled-edge sheet, thus forming a marked beveled-edge sheet.

In a fifth aspect of the invention, there is provided a method of reducing fuser roller edgewear in a fuser including a prior beveling of an inboard edge, an outboard edge, or both, of a paper sheet that is to be provided to the fuser.

DETAILED DESCRIPTION OF THE INVENTION

Briefly, fuser roller edgewear is reduced by a prior beveling of the inboard edge, the outboard edge, or both, of paper sheets that are to be provided to the fuser.

Figure 1:
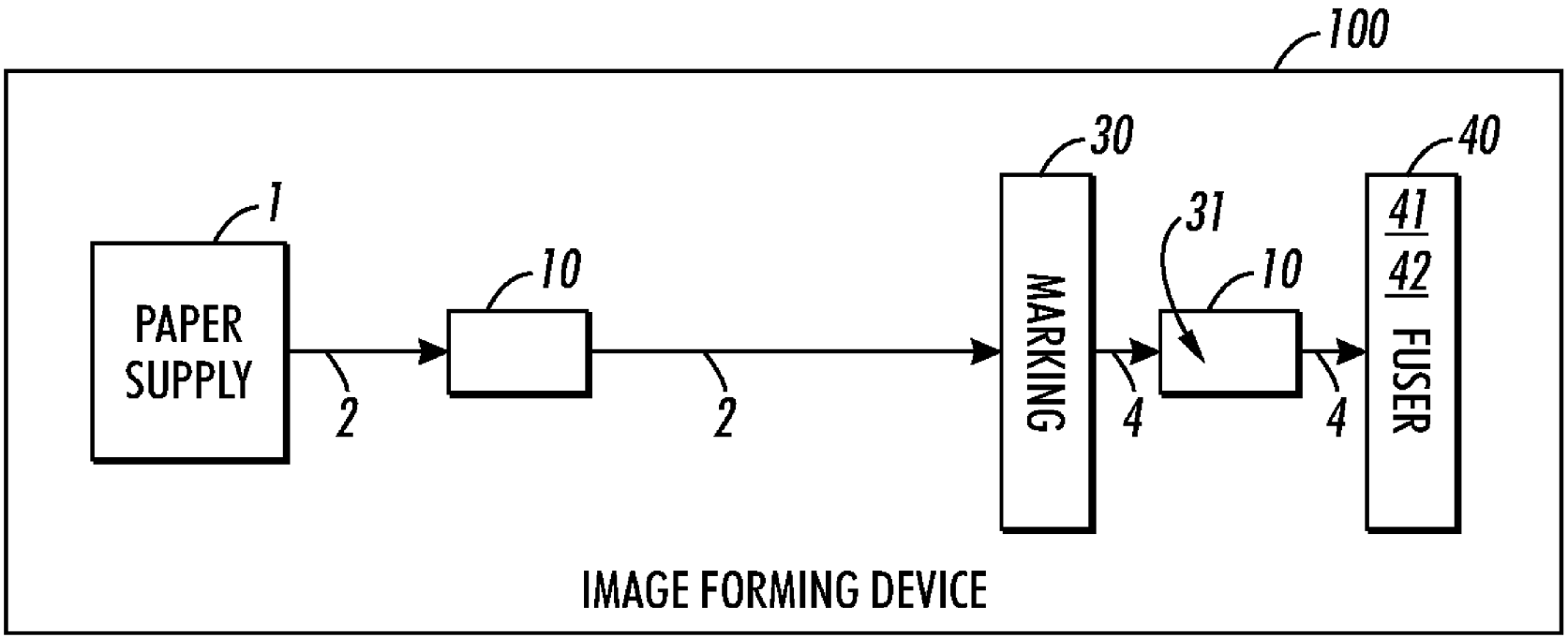
FIG. 1 PRIOR ART
FIG. 1 shows an image forming device 100 including a paper supply 1, a marking means 30 and a fuser 40.

Referring to FIG. 1 there is shown an image forming device 100 including a paper supply 1, a marking means 30 and a fuser 40. As shown, the paper supply 1 provides 2 a paper sheet 10 to the marking means 30. The marking means 30 is arranged to dispose a marking 31 on the paper sheet 10 and thereupon to provide 4 the paper sheet 10 comprising the disposed marking 31 to the fuser 40. In turn, the fuser 40 comprises a fuser elastomer member 41 and a fuser pressure member 42. The fuser elastomer member 41 comprises any of a belt and roller. The fuser pressure member 42 comprises any of a belt and roller.

Figure 2:
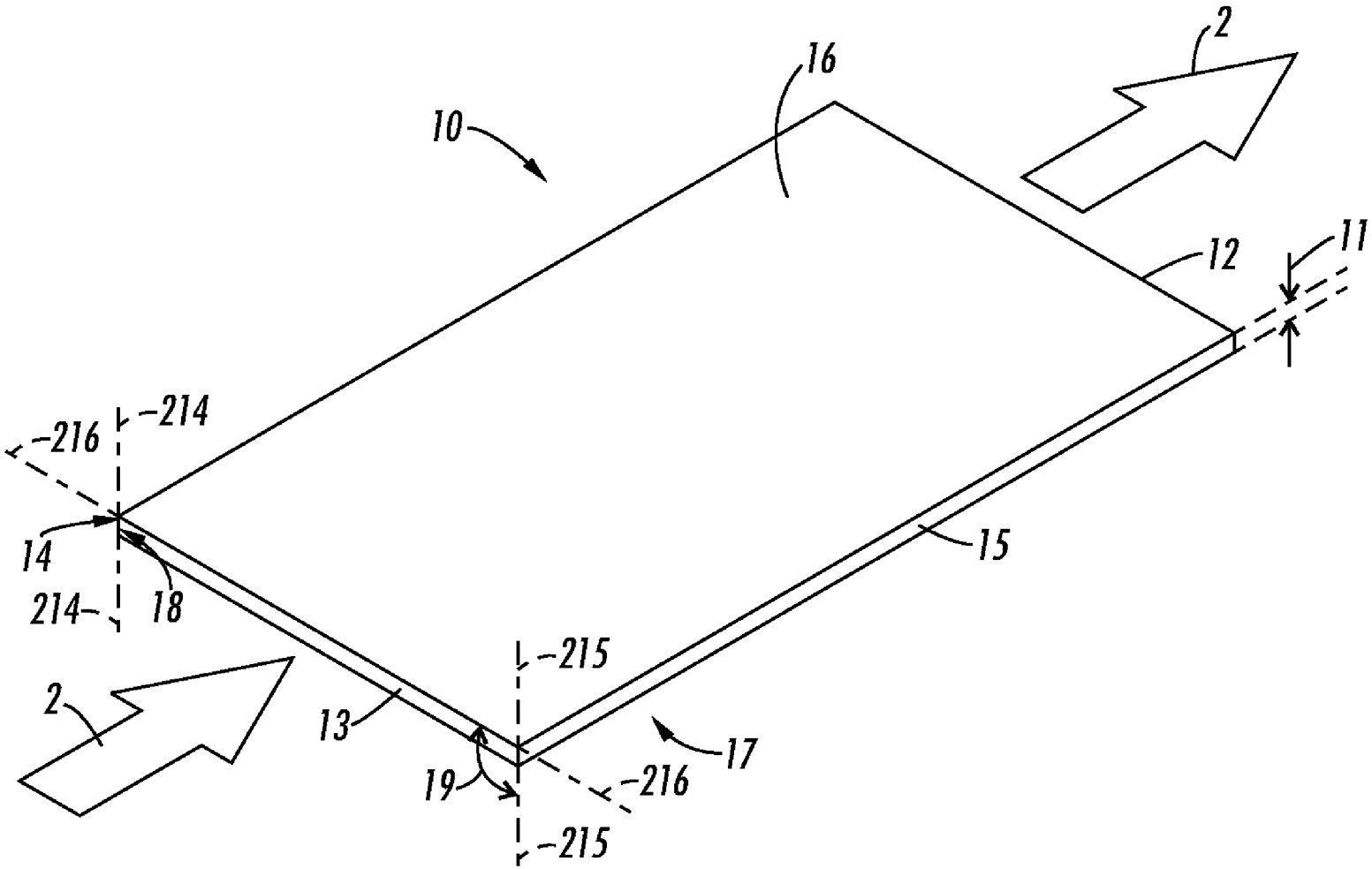
FIG. 2 shows a paper sheet 10 provided by the paper supply 1 of FIG. 1.

Referring to FIG. 2 there is depicted a paper sheet 10 as provided by the paper supply 1. Also shown is the paper travel path or process direction 2. The paper sheet 10 comprises a thickness 11, a leading edge 12, a trailing edge 13, an inboard edge 14, an outboard edge 15, a top surface 16 and a bottom surface 17. Also shown is an inboard edge reference line 214, co-linear with the junction of the trailing edge 13 and the inboard edge 14. Also shown is an outboard edge reference line 215, co-linear with the junction of the trailing edge 13 and the outboard edge 15. Also shown is a top surface reference line 216, co-linear with the junction of the trailing edge 13 and the top surface 16. Also shown is an inboard edge-top surface angle 18, which angle 18 is within, between and fixed by the inboard edge 14 and the top surface 16. Also shown is an outboard edge-top surface angle 19, which angle 19 is within, between and fixed by the outboard edge 15 and the top surface 16. In various embodiments, each of the inboard edge-top surface angle 18 and the outboard edge-top surface angle 19 generally are approximately ninety degrees (90°).

Figure 3:
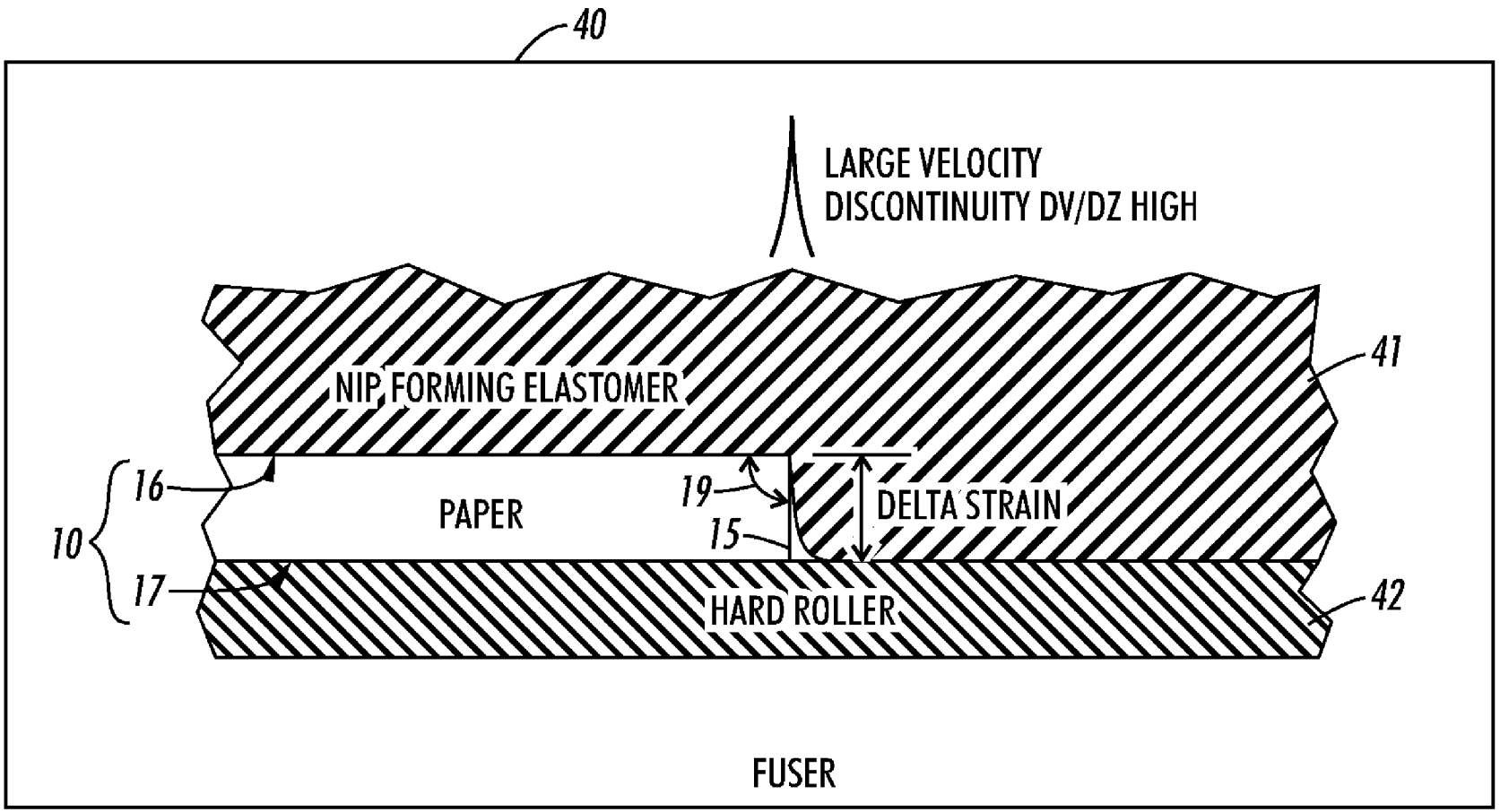
FIG. 3 PRIOR ART
FIG. 3 shows the fuser 40 of FIG. 1 including the paper sheet 10 of FIG. 2.

Referring to FIG. 3 there is shown the fuser 40, with a partial cross-sectional view of the FIG. 2 paper sheet 10 disposed between the fuser elastomer member 41 and the fuser pressure member 42. Also shown is a partial view of the sheet 10's outboard edge 15, top surface 16 and bottom surface 17. Also shown is an outboard edge-top surface angle 19, which angle 19 is within, between and fixed by the outboard edge 15 and the top surface 16.

Figure 4:
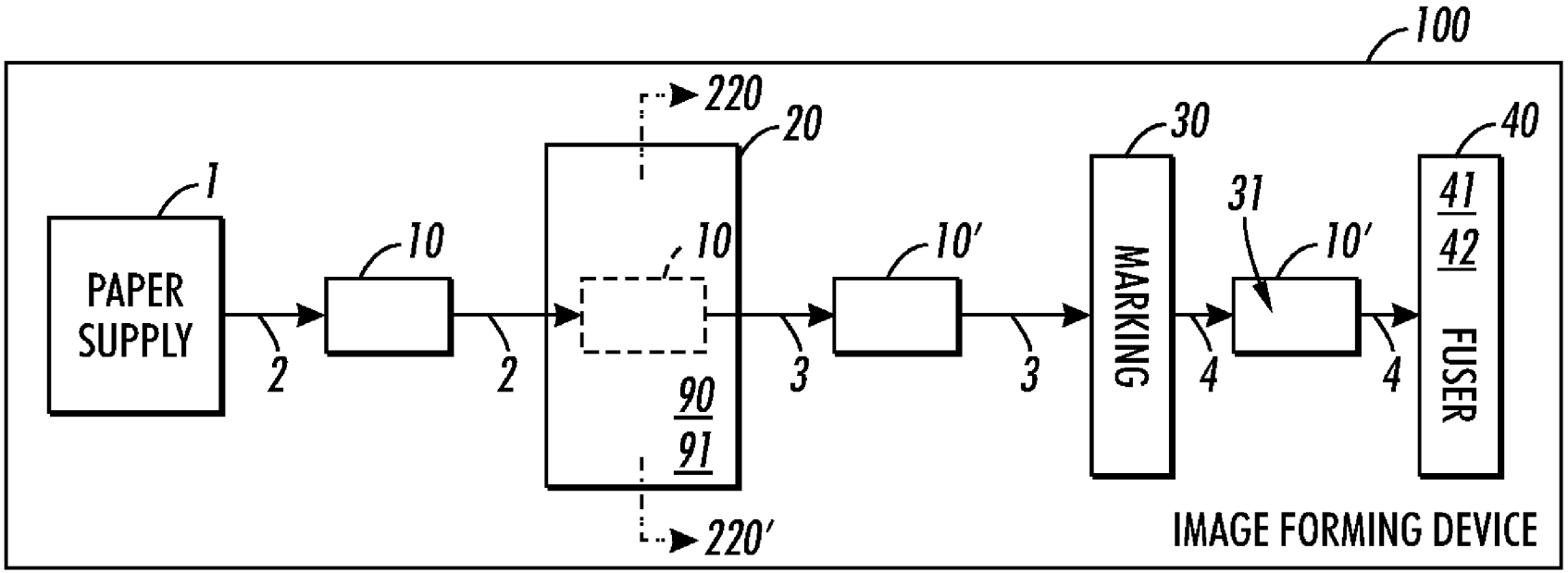
FIG. 4 shows the image forming device 100 of FIG. 1 arranged with a paper edge-beveling station 20, in accordance with the present invention.

Referring to FIG. 4 there is depicted the FIG. 1 image forming device 100 arranged with a paper edge-beveling station 20, in accordance with the present invention. As shown, the paper edge-beveling station 20 includes an inboard paper edge-beveling means 90 and an outboard paper edge-beveling means 91. As shown, the paper supply 1 provides 2 a paper sheet 10 to the edge-beveling station 20. As will be described in greater detail in connection with FIG. 5 below, in various embodiments the paper edge-beveling station 20 is arranged to bevel any of the paper inboard edge 14 and the paper outboard edge 15, thus forming the depicted paper beveled-edge sheet 10'. Thereafter the paper edge-beveling station 20 provides 3 the paper beveled-edge sheet 10' to the marking means 30. The marking means 30, in turn, is arranged to dispose a marking 31 on the paper beveled-edge sheet 10'. After marking the sheet 10' with the disposed marking 31, the marking means thereafter provides 4 the paper beveled-edge sheet 10' comprising the disposed marking 31 to the fuser 40. Also shown is a paper edge-beveling station reference line 220-220'.

Figure 5A:
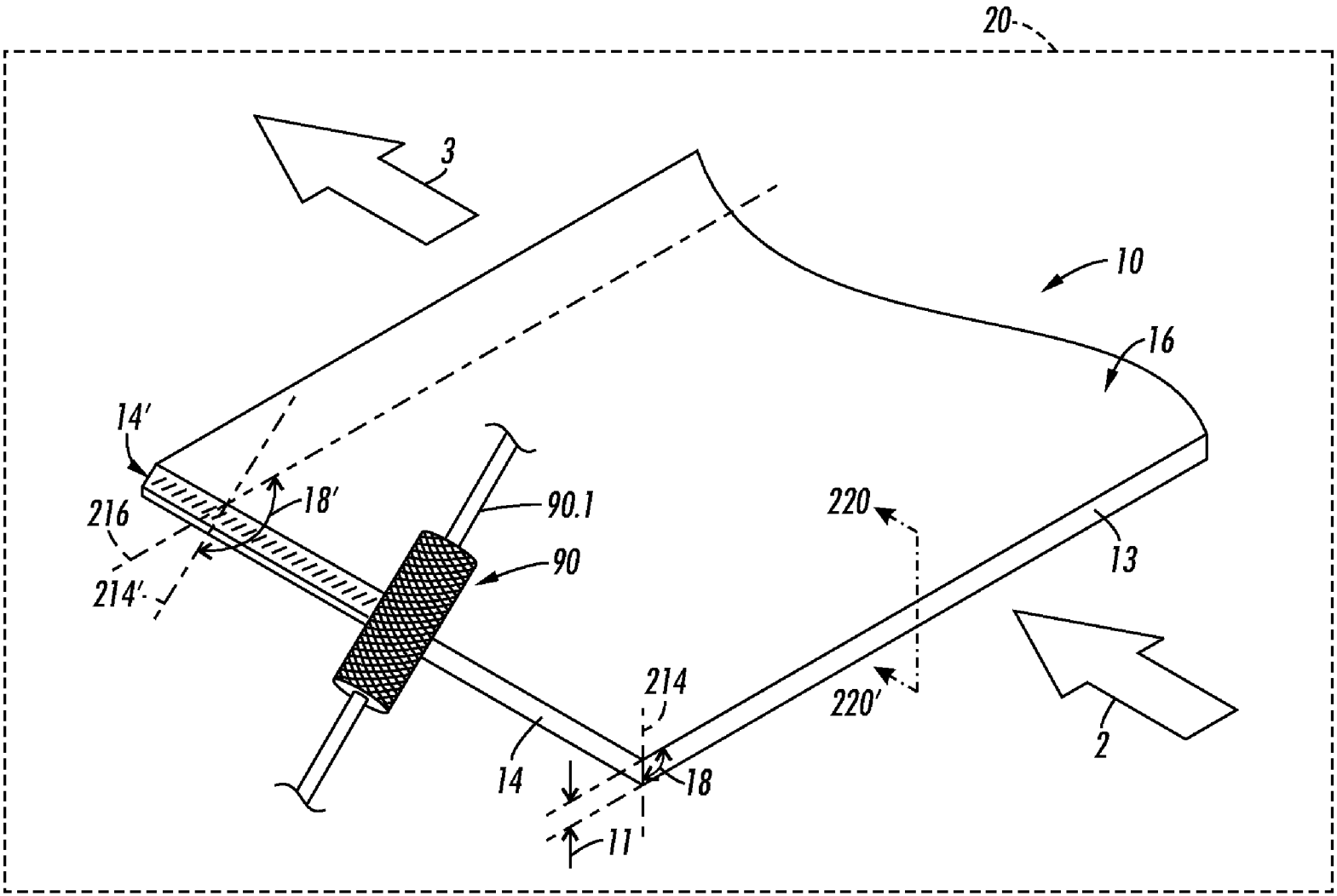
FIG. 5, comprising a first drawing view labeled FIG. 5A and a second drawing view labeled
FIG. 5B, shows the paper edge-beveling station 20 of FIG. 4.
Figure 5B:
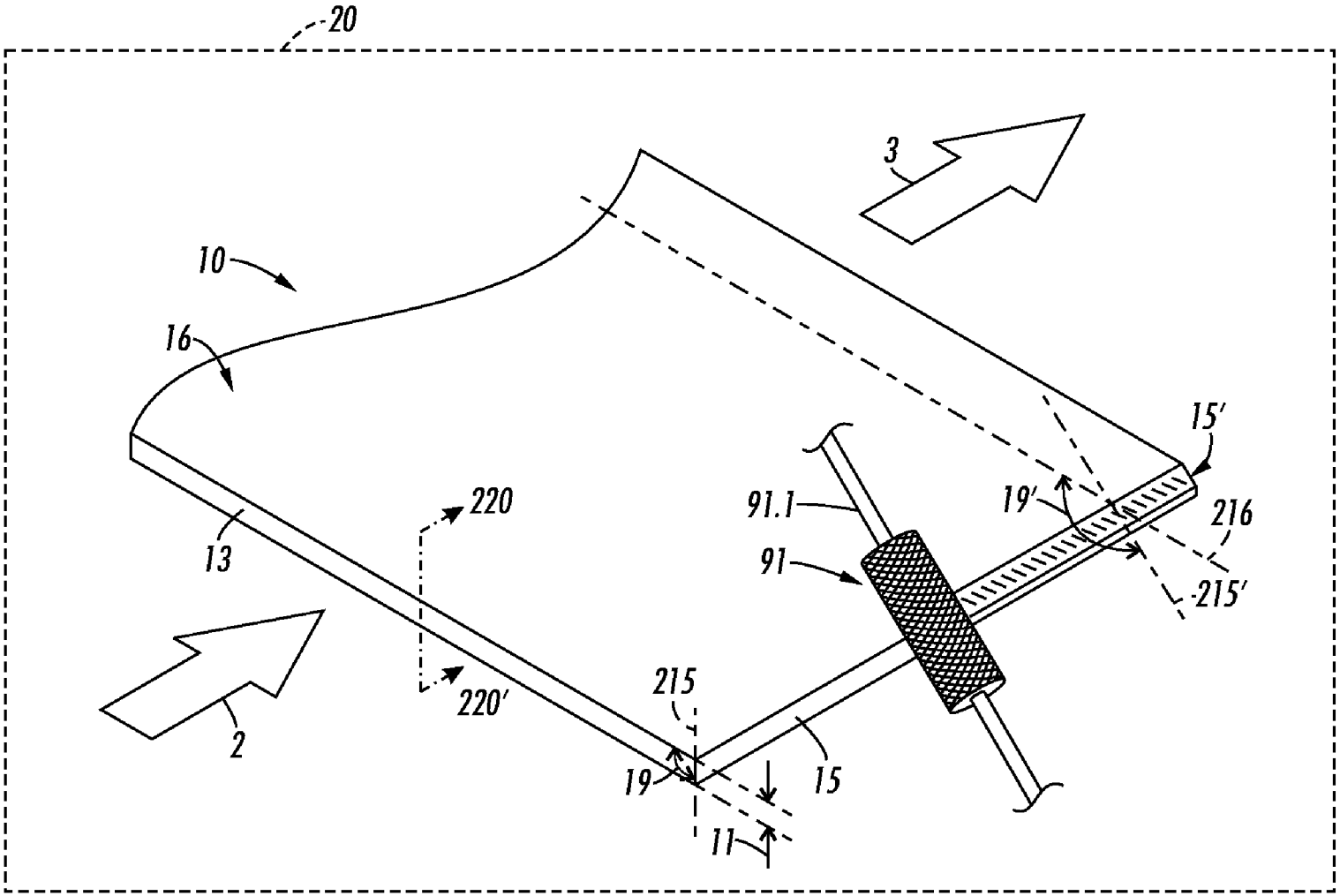

Referring to FIG. 5, comprising a first drawing view labeled FIG. 5A and a second drawing view labeled FIG. 5B, there is shown a cross-section view of the FIG. 4 paper edge-beveling station 20 along the FIG. 4 reference line 220-220'.

As shown in FIG. 5A, the inboard paper edge-beveling means 90 is arranged to bevel the paper inboard edge 14, thus forming the depicted paper inboard beveled edge 14'. FIG. 5A includes a newly-depicted outboard edge reference line 214', which line 214' is co-linear with the inboard beveled edge 14'. Also shown in FIG. 5A are the prior FIG. 2 inboard edge reference line 214 and the prior FIG. 2 top surface reference line 216. By comparing the prior inboard edge reference line 214 with the new FIG. 5A inboard beveled-edge reference line 214' it is seen that, as a result of the paper inboard edge 14 beveling by the inboard paper edge-beveling means 90, the original paper inboard edge-top surface angle 18 thereby is enlarged to form the depicted enlarged paper inboard beveled-edge-top surface angle 18'. For example, in various embodiments the original paper inboard edge-top surface angle 18 is approximately ninety degrees (90°). In contrast, in accordance with the present invention the enlarged paper inboard beveled-edge-top surface angle 18' is an obtuse angle and, in various embodiments, substantially greater than ninety degrees (90°).

As shown in FIG. 5B, the outboard paper edge-beveling means 91 is arranged to bevel the paper outboard edge 15, thus forming the depicted paper outboard beveled edge 15'. FIG. 5B includes a newly-depicted outboard edge reference line 215', which line 215' is co-linear with the inboard beveled edge 15'. Also shown in FIG. 5B are the prior FIG. 2 outboard edge reference line 215 and the prior FIG. 2 top surface reference line 216. By comparing the prior outboard edge reference line 215 with the new FIG. 5B outboard beveled-edge reference line 215' it is seen that, as a result of the paper outboard edge 15 beveling by the outboard paper edge-beveling means 91, the original paper outboard edge-top surface angle 19 thereby is enlarged to form the depicted enlarged paper outboard beveled-edge-top surface angle 19'. For example, in various embodiments the original paper outboard edge-top surface angle 19 is approximately ninety degrees (90°). In contrast, in accordance with the present invention the enlarged paper outboard beveled-edge-top surface angle 19' is an obtuse angle and, in various embodiments, substantially greater than ninety degrees (90°).

Referring generally to FIGS. 5A and 5B, in various embodiments the inboard paper edge-beveling means 90 rotates about the depicted inboard paper edge-beveling means axial 90.1 to provide a crushing action to the paper inboard edge 14. Also, in various embodiments the outboard paper edge-beveling means 91 rotates about the depicted outboard paper edge-beveling means axial 91.1 to provide a crushing action to the paper outboard edge 15.

Still referring generally to FIGS. 5A and 5B, in various embodiments the inboard paper edge-beveling means 90 is fixed and thus does not rotate to provide a grinding action to the paper inboard edge 14. Also, in various embodiments the outboard paper edge-beveling means 91 is fixed and thus does not rotate to provide a grinding action to the paper outboard edge 15.

With continued reference to FIGS. 5A and 5B, it is common and well-known in the art to bevel paper edges and, accordingly, one skilled in the art could easily fabricate the present inboard paper edge-beveling means 90 and the present outboard paper edge-beveling means 91 that are described above in connection with FIGS. 5A and 5B, respectively. For example, the aforementioned U.S. Pat. No. 1,008,609 granted 14 Nov. 1911 to Joseph W. Moore ("Moore") describes using grinding devices to form paper beveled edges similar or identical to the present paper inboard beveled edge 14' and present paper outboard beveled edge 15'. For example, see the Moore patent at page 1, lines 12-18 and 80-106; page 2, lines 45-51; and page 3, lines 79-93. See also the aforementioned U.S. Pat. No. 2,180,433 granted 21 Nov. 1939 to John Page et al., especially at page 2, right-hand column, lines 21-31; and page 3, left-hand column, lines 71-75. See also the aforementioned U.S. Pat. No. 2,217,306 granted 8 Oct. 1940 to Harold Griswold Burrill, especially at page 1, left-hand column, lines 34-51 and right-hand column, lines 36-48; and page 2, left-hand column, lines 27-49 and right-hand column, lines 1-37. The disclosures of the aforementioned three (3) patents to Joseph W. Moore, John Page et al. and Harold Griswold Burrill are herein incorporated by reference verbatim and with the same effect as though the identical disclosures were presented hereinat in their entireties.

Figure 6:
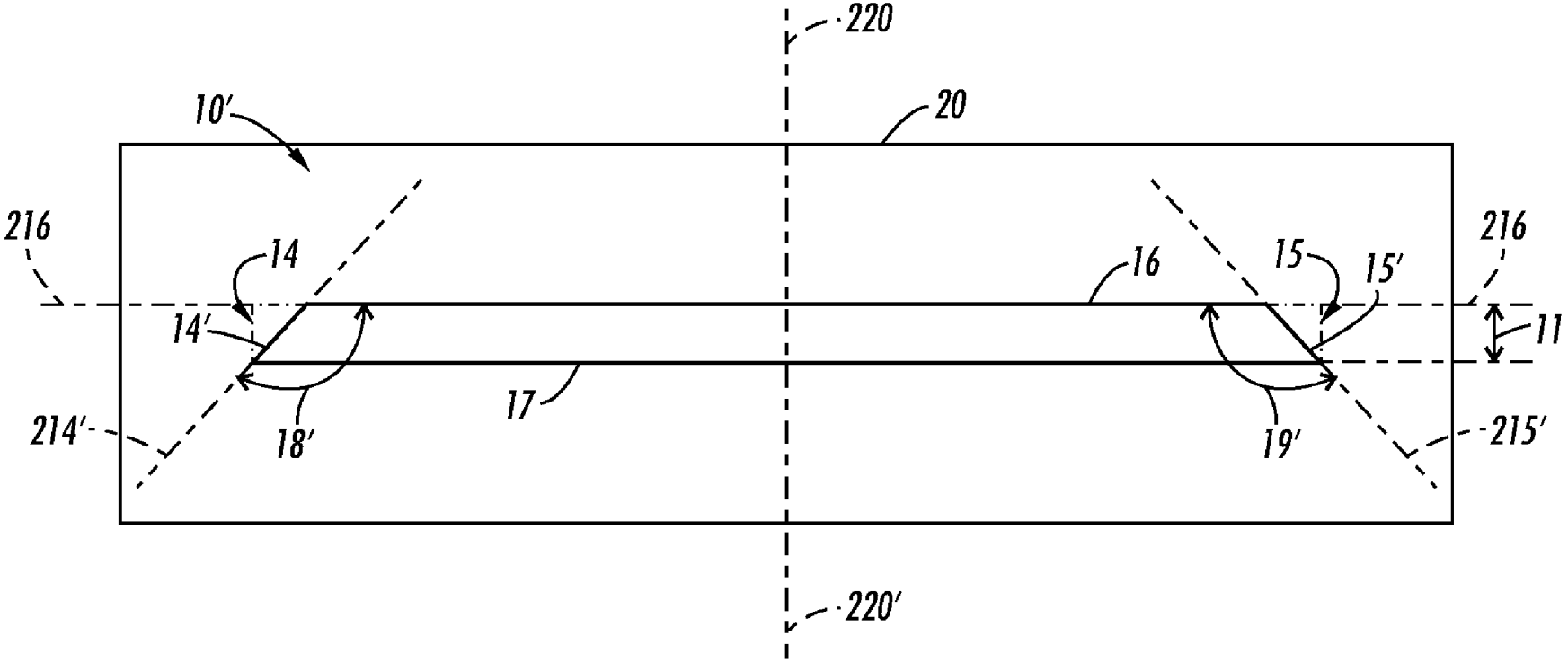
FIG. 6 shows a paper beveled-edge sheet 10' provided by the paper edge-beveling station 20 of FIG. 5.

Referring to FIG. 6 there is depicted a cross-section view along the reference line 220-220' of the paper beveled-edge sheet 10' as provided by the paper edge-beveling station 20 to the marking means 30. As shown, the paper beveled-edge sheet 10' comprises the thickness 11, the inboard beveled edge 14', the outboard beveled edge 15', the top surface 16 and the bottom surface 17. Note the prior FIG. 2 paper inboard edge 14 is shown in dotted lines for comparison with the present paper inboard beveled edge 14'. Also note the prior FIG. 2 paper outboard edge 15 is shown in dotted lines for comparison with the present paper outboard beveled edge 15'. Also shown is the FIG. 5A enlarged paper inboard beveled-edge-top surface angle 18' and the FIG. 5B enlarged paper outboard beveled-edge-top surface angle 19'. As shown, both of these enlarged angles 18' and 19' are obtuse and, in various embodiments, substantially greater than ninety degrees (90°). Also shown are the FIG. 5A paper inboard beveled-edge reference line 214' and the FIG. 5B outboard edge reference line 215'. Also shown is the FIG. 2 paper top surface reference line 216.

As discussed in connection with FIG. 4 above, upon receiving the paper beveled-edge sheet 10' from the paper edge-beveling station 20, the marking means 30, in turn, disposes a marking 31 on the paper beveled-edge sheet 10'. After marking the sheet 10' with the disposed marking 31, the marking means thereupon provides 4 the paper beveled-edge sheet 10' comprising the disposed marking 31 to the fuser 40.

Figure 7:
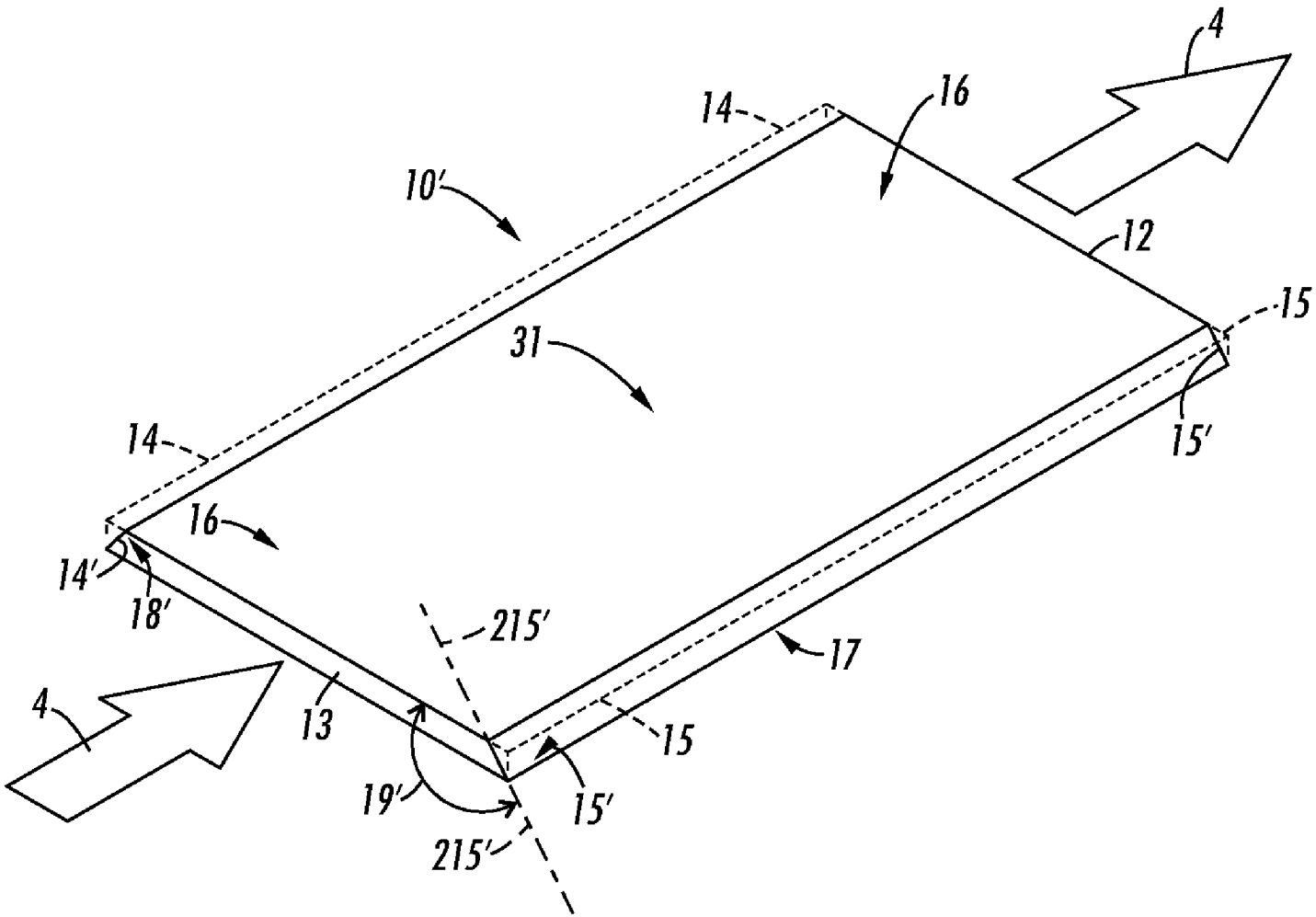
FIG. 7 shows a paper beveled-edge sheet 10' comprising a disposed marking 31.

Referring now to FIG. 7 there is shown the paper beveled-edge sheet 10' comprising the disposed marking 31 as provided to the fuser 40. Also shown is the paper 10' travel path or process direction 4. As shown, the paper beveled-edge sheet 10' comprises the thickness 11, the leading edge 12, the trailing edge 13, the inboard beveled edge 14', the outboard beveled edge 15', the top surface 16 and the bottom surface 17. Note the prior FIG. 2 paper inboard edge 14 is shown in dotted lines for comparison with the present paper inboard beveled edge 14'. Also note the prior FIG. 2 paper outboard edge 15 is shown in dotted lines for comparison with the present paper outboard beveled edge 15'. Also shown is the FIG. 5A enlarged paper inboard beveled-edge-top surface angle 18' and the FIG. 5B enlarged paper outboard beveled-edge-top surface angle 19'. Also shown is the FIG. 5B outboard edge reference line 215'.

Figure 8:
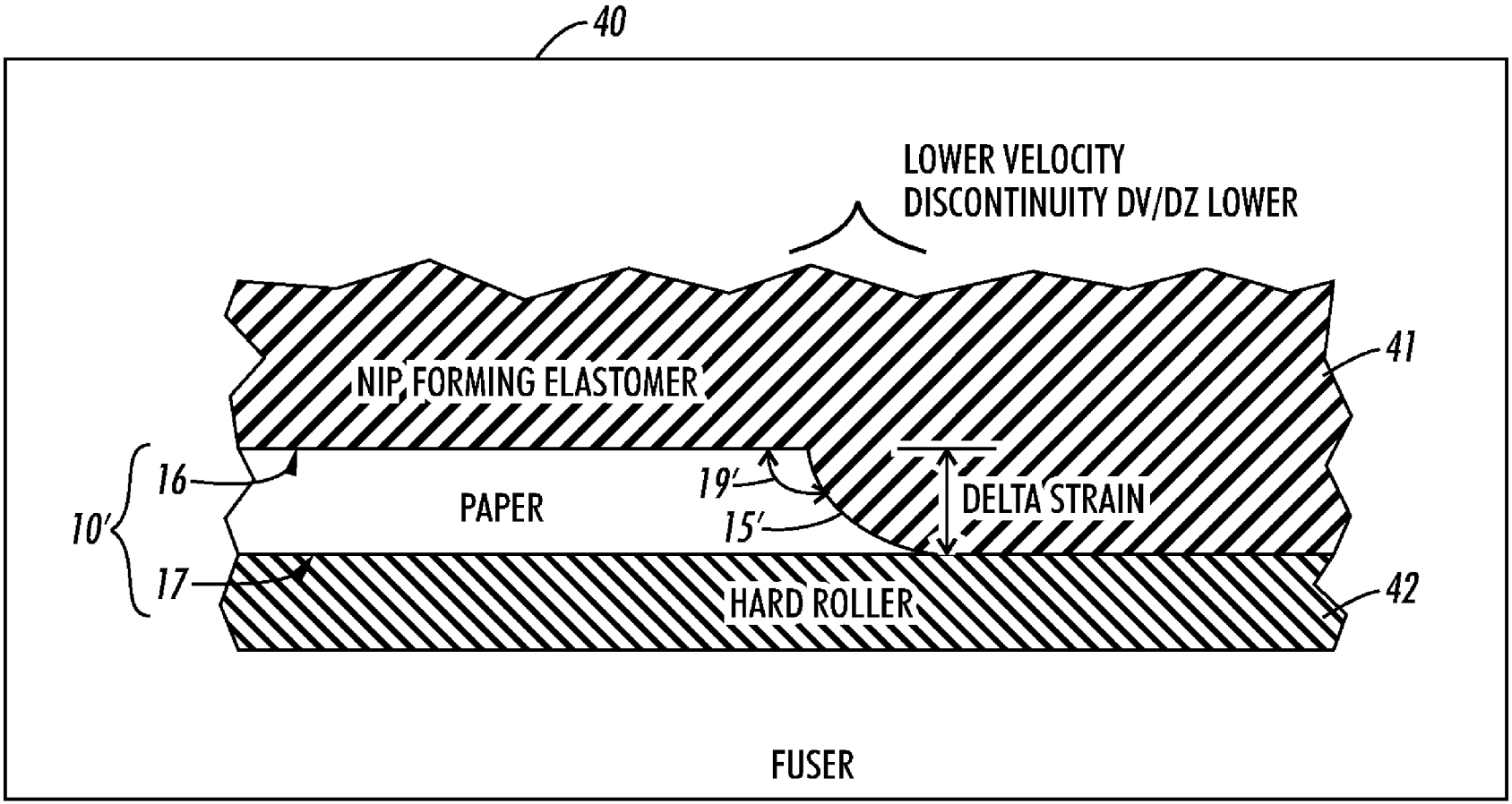
FIG. 8 shows the fuser 40 of FIG. 1 including the paper beveled-edge sheet 10' of FIG. 7.

Referring to FIG. 8 there is depicted the fuser 40, with a partial cross-sectional view of the FIG. 7 paper beveled-edge sheet 10' disposed between the fuser elastomer member 41 and the fuser pressure member 42. Also shown is a partial view of the paper outboard beveled edge 15', top surface 16 and bottom surface 17. Also shown is the FIG. 5B enlarged paper outboard beveled-edge-top surface angle 19'. As discussed in connection with FIG. 5B above, in accordance with the present invention the enlarged paper outboard beveled-edge-top surface angle 19' is an obtuse angle and, in various embodiments, substantially greater than ninety degrees (90°).

In summary, fuser roller edgewear is reduced by a prior beveling of the inboard edge, the outboard edge, or both, of paper sheets that are to be provided to the fuser.

Moreover, the present invention reduces the fuser roller edgewear by reducing the sharp strain discontinuity at the paper edge. This is done by creating a "beveled" edge prior to entering the fuser. Instead of the strain and velocity difference potential being concentrated at a single point on the roller, this velocity potential is distributed over a large area. This will not eliminate the edge wear but it will reduce it to the point of significantly improved fuser roller life. The paper edges are beveled in one of three ways. 1) Manufacture paper with beveled edges, 2) bevel the edges of the paper in the machine by a grinding process, or 3) bevel the edges in the machine by a "crushing" process.

Hence, as shown in FIG. 3, the present sharp square edge of the paper 10 causes a velocity discontinuity at the edge 15. The average speed of the elastomer 41 where it is in contact with the paper 10 must be higher than outside the paper path because of the incompressibility of the elastomer. The elastomer surface does not have sufficient friction to support this velocity gradient. As a result, there must be slippage in the paper edge zone.

In contrast, as shown in FIG. 8, in accordance with the present invention a paper sheet 10' with a beveled edge 15' is shown in the fuser nip. There is the same delta velocity potential because the thickness of the paper 10' is the same, but the delta potential is distributed over a large area. Two benefits result. 1) there is not a distinguished "cut" zone as in FIG. 3, 2) because dv/dz is lower, it is possible for the elastomer 41 to support this velocity differential with less or no slippage. Both of these effects will reduce edge wear considerably.

Three methods for providing the beveled edge are available:

1) Manufacture the paper that way (probably not practical as many printers cut their own paper).

2) Grind a bevel edge during the transport of the paper through the machine.

3) Crush or "coin" a bevel edge during the paper transport.

Method 2. Grind. This is conceptually simple. It would involve one or more abrasive surfaces at a proper angle place in the paper path (maybe ideally at the paper supply area) that grinds a bevel on the way to the paper path. You would probably need a small vacuum source to scavenge the dust that is generated during the process.

Method 3. Crush. In this method, the paper edge run through a set or succession of hard metal nip rollers that forms a beveled edge in the paper. The advantage is that the method is "cleaner" (no dust is generated), but may be not as reliable as grinding.

Thus, there is described the first aspect of the invention, substantially as described in claim 1 below, namely, a method for an image forming device 100 to process a paper sheet 10, the paper sheet having an inboard edge 14, an outboard edge 15 and a top surface 16, the method comprising: (a) forming a beveled-edge paper sheet 10' by any of (i) enlarging the inboard edge-top surface angle 18 that is formed by the inboard edge 14 and the top surface 16 and (ii) enlarging the outboard edge-top surface angle 19 that is formed by the outboard edge 15 and the top surface 16; and (b) providing the paper beveled-edge sheet 10' to an included fuser 40.

In one variation, substantially as described in claim 2 below, the method includes disposing a marking 31 on the paper beveled-edge sheet 10' by means of an included marking means 30.

In a further variation, substantially as described in claim 3 below, the inboard edge-top surface angle 18 enlarging includes beveling the inboard edge 14 by an included inboard edge-beveling means 90.

In another variation, substantially as described in claim 4 below, the inboard-edge beveling includes any of a grinding and a crushing.

In a further variation, substantially as described in claim 5 below, the outboard edge-top surface angle 19 enlarging includes beveling the outboard edge 15 by an included outboard edge-beveling means 91.

In another variation, substantially as described in claim 6 below, the outboard-edge beveling includes any of a grinding and a crushing.

In a further variation, substantially as described in claim 7 below, the method includes both enlarging the inboard edge-top surface angle 18 so that the resulting enlarged inboard edge-top surface angle 18' exceeds ninety degrees (90°) and also enlarging the outboard edge-top surface angle 19 so that the resulting enlarged outboard edge-top surface angle 19' exceeds ninety degrees (90°).

Also, there is described the second aspect of the invention, substantially as described in claim 8 below, namely, a method for reducing fuser roller edgewear in a fuser 40, the fuser arranged for fusing one or more paper sheets 10, each paper sheet 10 having an inboard edge 14, an outboard edge 15 and a top surface 16, the method comprising, for each paper sheet 10 to be provided to the fuser, (i) enlarging the inboard edge-top surface angle 18 that is formed by the inboard edge 14 and the top surface 16; or (ii) enlarging the outboard edge-top surface angle 19 that is formed by the outboard edge 15 and the top surface 16; or both (i) enlarging the inboard edge-top surface angle 18 and (ii) enlarging the outboard edge-top surface angle 19.

In one variation, substantially as described in claim 9 below, the method includes both enlarging the inboard edge-top surface angle 18 so that the resulting enlarged inboard edge-top surface angle 18' is an obtuse angle and also enlarging the outboard edge-top surface angle 19 so that the resulting enlarged outboard edge-top surface angle 19' also is an obtuse angle.

Also, there is described the third aspect of the invention, substantially as described in claim 10 below, namely, a method for processing a paper sheet 10, the paper sheet having an inboard edge 14, an outboard edge 15 and a top surface 16, the method comprising any of (i) enlarging the inboard edge-top surface angle 18 that is formed by the inboard edge 14 and the top surface 16 and (ii) enlarging the outboard edge-top surface angle 19 that is formed by the outboard edge 15 and the top surface 16, thus forming a beveled-edge paper sheet 10'; disposing a marking 31 on the paper beveled-edge sheet 10' thus forming a marked paper beveled-edge sheet 10', and providing the marked paper beveled-edge sheet 10' to an included fuser 40.

In one variation, substantially as described in claim 11 below, the inboard edge-top surface angle 18 enlarging includes beveling the inboard edge 14.

In a further variation, substantially as described in claim 12 below, the inboard-edge beveling includes a grinding.

In another variation, substantially as described in claim 13 below, the inboard-edge beveling includes a crushing.

In a further variation, substantially as described in claim 14 below, the outboard edge-top surface angle 19 enlarging includes beveling the outboard edge 15.

In another variation, substantially as described in claim 15 below, the outboard-edge beveling includes any of a grinding and a crushing.

In a further variation, substantially as described in claim 16 below, the method includes both enlarging the inboard edge-top surface angle 18 so that the resulting enlarged inboard edge-top surface angle 18' exceeds ninety degrees (90°) and also enlarging the outboard edge-top surface angle 19 so that the resulting enlarged outboard edge-top surface angle 19' exceeds ninety degrees (90°).

Also, there is described the fourth aspect of the invention, substantially as described in claim 17 below, namely, an image forming device 100 arranged to process paper sheets, each paper sheet having an inboard edge 14, an outboard edge 15 and a top surface 16, the image forming device arranged for edge-beveling each paper sheet by any of (i) enlarging the inboard edge-top surface angle 18 that is formed by the inboard edge 14 and the top surface 16 and (ii) enlarging the outboard edge-top surface angle 19 that is formed by the outboard edge 15 and the top surface 16, thus forming a paper beveled-edge sheet 10', the device including marking means 30 for disposing a marking 31 on the paper beveled-edge sheet 10', thus forming a marked paper beveled-edge sheet 10'.

In one variation, substantially as described in claim 18 below, the image forming device includes a fuser 40 for fusing the marked paper beveled-edge sheet 10'.

In a further variation, substantially as described in claim 19 below, the image forming device includes inboard edge-beveling means 90 for beveling the inboard edge 14 to enlarge the inboard edge-top surface angle 18.

In another variation, substantially as described in claim 20 below, the image forming device includes outboard edge-beveling means 91 for beveling the outboard edge 15 to enlarge the outboard edge-top surface angle 19.

In a further variation, substantially as described in claim 21 below, the inboard edge-beveling means 90 is arranged to enlarge the inboard edge-top surface angle 18 so that the resulting enlarged inboard edge-top surface angle 18' is an obtuse angle and also where the outboard edge-beveling means 91 is arranged to enlarge the outboard edge-top surface angle 19 so that the resulting enlarged outboard edge-top surface angle 19' also is an obtuse angle.

In another variation, substantially as described in claim 22 below, the inboard 90 and outboard 91 edge-beveling means comprise a grinding means.

In a further variation, substantially as described in claim 23 below, the inboard 90 and outboard 91 edge-beveling means comprise a crushing means.

Also, there is described the fourth aspect of the invention, substantially as described in claim 24 below, namely, a method of reducing fuser roller edgewear in a fuser 40 including a prior beveling of an inboard edge 14, an outboard edge 15, or both, of a paper sheet 10 that is to be provided to the fuser 40.

The table below lists the drawing element reference numbers together with their corresponding written description:

REF. NO.: DESCRIPTION

1 paper supply
2 paper travel path or process direction
3 paper travel path or process direction
4 paper travel path or process direction
10 paper sheet
10' paper beveled-edge sheet
11 paper thickness
12 paper leading edge
13 paper trailing edge
14 paper inboard edge
14' paper inboard beveled edge
15 paper outboard edge
15' paper outboard beveled edge
16 paper top surface
17 paper bottom surface
18 paper inboard edge-top surface angle
18' paper inboard beveled-edge-top surface angle
19 paper outboard edge-top surface angle
19' paper outboard beveled-edge-top surface angle
20 paper edge-beveling station
30 marking means
31 disposed marking
40 fuser
41 fuser elastomer member, belt or roller
42 fuser pressure member, belt or roller
90 inboard paper edge-beveling means
90.1 inboard paper edge-beveling means axial
91 outboard paper edge-beveling means
91.1 outboard paper edge-beveling means axial
100 image forming device
214 paper inboard edge reference line
214' paper inboard beveled-edge reference line
215 paper outboard edge reference line
215' paper outboard beveled-edge reference line
216 paper top surface reference line
220-220' paper edge-beveling station reference line While various embodiments of a paper edge-beveling method, and an image forming device including the same, in accordance with the present invention, are described above, the scope of the invention is defined by the following claims.

What is claimed is:

1. A method for an image forming device to process a paper sheet, said paper sheet having a leading edge, a trailing edge, an inboard edge, an outboard edge, and a top surface, said leading edge and said trailing edge being approximately perpendicular to a feeding direction of said paper sheet and said inboard edge and said outboard edge being approximately parallel to said feeding direction of said paper sheet, said method comprising:

forming a beveled-edge paper sheet by one of:

enlarging an inboard edge-top surface angle of said paper sheet that is formed by an intersection of a plane of said inboard edge and a plane of said top surface, said enlarging an inboard edge-top surface angle comprising beveling said inboard edge by grinding to form an inboard beveled-edge-top surface angle of said paper sheet; and enlarging an outboard edge-top surface angle of said paper sheet that is formed by an intersection of a plane of said outboard edge and said plane of said top surface, said enlarging an outboard edge-top surface angle comprising beveling said outboard edge by grinding to form an outboard beveled-edge-top surface angle of said paper sheet;

feeding said beveled-edge paper sheet to an included fuser in said image forming device, said fuser includes an elastomer member and a pressure member that receives said beveled-edge paper sheet therebetween; and deforming a portion of said elastomer member of said fuser to substantially conform to one of said inboard beveled-edge-top surface angle of said beveled inboard edge and said outboard beveled-edge-top surface angle of said beveled outboard edge.

2. The method of claim 1, further comprising:

disposing a marking on said beveled-edge paper sheet.

3. The method of claim 1, including both enlarging said inboard edge-top surface angle so that the resulting enlarged inboard beveled-edge-top surface angle exceeds ninety degrees (90°) and also enlarging said outboard edge-top surface angle so that the resulting enlarged outboard beveled-edge-top surface angle exceeds ninety degrees (90°).

4. A method for processing a paper sheet, said paper sheet having a leading edge, a trailing edge, an inboard edge, an outboard edge, and a top surface, said leading edge and said trailing edge being approximately perpendicular to a feeding direction of said paper sheet and said inboard edge and said outboard edge being approximately parallel to said feeding direction of said paper sheet, said method comprising:

forming a beveled-edge paper sheet by one of:

enlarging an inboard edge-top surface angle of said paper sheet that is formed by an intersection of a plane of said inboard edge and a plane of said top surface, said enlarging an inboard edge-top surface angle comprising beveling said inboard edge by grinding to form an inboard beveled-edge-top surface angle of said paper sheet; and enlarging an outboard edge-top surface angle of said paper sheet that is formed by an intersection of a plane of said outboard edge and said plane of said top surface, said enlarging an outboard edge-top surface angle comprising beveling said outboard edge by grinding to form an outboard beveled-edge-top surface angle of said paper sheet;

disposing a marking on said beveled-edge paper sheet thus forming a marked beveled-edge paper sheet; and feeding said marked beveled-edge paper sheet to a fuser, said fuser includes an elastomer member and a pressure member that receives said beveled-edge paper sheet therebetween; and deforming a portion of said elastomer member of said fuser to substantially conform to one of said inboard beveled-edge-top surface angle of said beveled inboard edge and said outboard beveled-edge-top surface angle of said beveled outboard edge.

5. The method of claim 4, including both enlarging said inboard edge-top surface angle so that the resulting enlarged inboard beveled-edge-top surface angle exceeds ninety degrees (90°) and also enlarging said outboard edge-top surface angle so that the resulting enlarged outboard beveled-edge-top surface angle exceeds ninety degrees (90°).

6. An image forming device arranged to process paper sheets, each paper sheet having a leading edge, a trailing edge, an inboard edge, an outboard edge, and a top surface, said leading edge and said trailing edge being approximately perpendicular to a feeding direction of said paper sheet and said inboard edge and said outboard edge being approximately parallel to said feeding direction of said paper sheet, said image forming device comprising:

at least one first grinding device enlarging an inboard edge-top surface angle of said paper sheet that is formed by an intersection of a plane of said inboard edge and a plane of said top surface by beveling said inboard edge to enlarge said inboard edge-top surface angle, so that the resulting inboard beveled-edge-top surface angle is an obtuse angle;

at least one second grinding device enlarging an outboard edge-top surface angle of said paper sheet that is formed by an intersection of a plane of said outboard edge and said plane of said top surface by beveling said outboard edge to enlarge said outboard edge-top surface angle, so that the resulting outboard beveled-edge-top surface angle is an obtuse angle, thus forming a beveled-edge paper sheet;

a marking device that disposes a marking on said beveled-edge paper sheet, thus forming a marked beveled-edge paper sheet; and a fuser including a portion of an elastomer member that substantially conforms to one of said inboard beveled-edge-top surface angle of said beveled inboard edge and said outboard beveled-edge-top surface angle of said beveled outboard edge.

7. An image forming device arranged to process paper sheets, each paper sheet having a leading edge, a trailing edge, an inboard edge, an outboard edge, and a top surface, said leading edge and said trailing edge being approximately perpendicular to a feeding direction of said paper sheet and said inboard edge and said outboard edge being approximately parallel to said feeding direction of said paper sheet, said image forming device comprising:

at least one grinding device enlarging an inboard edge-top surface angle of said paper sheet that is formed by an intersection of a plane of said inboard edge and a plane of said top surface by beveling said inboard edge to enlarge said inboard edge-top surface angle, so that the resulting inboard beveled-edge-top surface angle is an obtuse angle;

at least one grinding device enlarging an outboard edge-top surface angle of said paper sheet that is formed by an intersection of a plane of said outboard edge and said plane of said top surface by beveling said outboard edge to enlarge said outboard edge-top surface angle, so that the resulting outboard beveled-edge-top surface angle is an obtuse angle, thus forming a beveled-edge paper sheet;

a marking device disposing a marking on said beveled-edge paper sheet, thus forming a marked beveled-edge paper sheet; and a fuser including an elastomer member and a corresponding pressure member that receives said marked beveled-edge paper sheet therebetween, a portion of said elastomer member of said fuser substantially conforming to one of said inboard beveled-edge-top surface angle of said beveled inboard edge and said outboard beveled-edge-top surface angle of said beveled outboard edge.

* * * * *